US008916323B2

(12) United States Patent
Sugama et al.

(10) Patent No.: US 8,916,323 B2
(45) **Date of Patent: *Dec. 23, 2014**

(54) TONER FOR ELECTROSTATIC IMAGE DEVELOPMENT

(71) Applicant: Konica Minolta, Inc., Tokyo (JP)

(72) Inventors: Kouji Sugama, Tokyo (JP); Hiroshi Nagasawa, Tokyo (JP); Hiroyuki Konno, Tokyo (JP); Takako Kawamura, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 54 days.

This patent is subject to a terminal disclaimer.

(21) Appl. No.: 13/867,242

(22) Filed: Apr. 22, 2013

(65) Prior Publication Data

US 2013/0280650 A1 Oct. 24, 2013

(30) Foreign Application Priority Data

Apr. 24, 2012 (JP) ..... 2012-098559

(51) Int. Cl.
*G03G 9/08* (2006.01)
*G03G 9/087* (2006.01)

(52) U.S. Cl.
CPC ..... *G03G 9/08711* (2013.01); *G03G 9/08755* (2013.01)
USPC ..... 430/109.3; 430/108.4

(58) Field of Classification Search
CPC ..... G03G 9/08711; G03G 9/08755
USPC ..... 430/109.3, 108.4
See application file for complete search history.

(56) References Cited

FOREIGN PATENT DOCUMENTS

| | | | |
|---|---|---|---|
| JP | 2004-286842 | A | 10/2004 |
| JP | 2001-222138 | A | 8/2011 |
| JP | 2011-149999 | A | 8/2011 |

*Primary Examiner* — Mark A Chapman

(74) *Attorney, Agent, or Firm* — Lucas & Mercanti, LLP

(57) ABSTRACT

The toner can obtain low-temperature fixing property, heat-resistant storability and long-term stability of charging while having excellent low-temperature fixing property. The toner is formed with toner particles containing a binder resin and a crystalline ester compound, the crystalline ester compound has a linear-chain structure, and the binder resin contains a styrene-acrylic resin including a structural unit derived from an acrylic ester monomer represented by general formula (1) below. In the general formula (1), $R^1$ represents a hydrogen atom or a methyl group, and $R^2$ represents a hydrogen atom, an alkyl group having 1 to 16 carbon atoms or an aryl group having 6 to 15 carbon atoms. m represents 2 or 3, and n represents an integer of 1 to 25.

General formula (1)

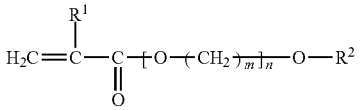

16 Claims, No Drawings

TONER FOR ELECTROSTATIC IMAGE DEVELOPMENT

CROSS REFERENCE TO RELATED APPLICATION

This Application claims the priority of Japanese Patent Application No, 2012-098559 filed on Apr. 24, 2012, which is incorporated herein by reference in its entirety.

BACKGROUND OF THE INVENTION

1. Field of the Invention

The present invention relates to a toner for electrostatic-image development, which is used for image formation of an electrophotographic method.

2. Description of the Related Art

In recent years, in order to further save energy in the image forming device of an electrophotographic method, there has been required a toner for electrostatic-image development (which hereinafter may be simply referred to as a "toner") with which heat fixing can be performed at a lower temperature. In such a toner, in order to achieve more excellent low-temperature fixing property and stably form a high quality image over a long period of time, there has been required a toner that satisfies long-term stability of charging.

For example, there is widely known a toner that contains a crystalline material as a fixing aid, specifically, a crystalline ester compound such as a crystalline polyester resin or a fatty acid ester compound (for example, see Patent Literature 2).

However, in the toner containing the fixing aid as disclosed in Patent Literature 1, when the compatibility between the crystalline ester compound and the binder resin at the time of heat fixing is high, there arises a problem in which the plasticity of the binder resin proceeds before the heat fixing and this causes the heat-resistant storability of the toner to be degraded, whereas, when the compatibility is low, there are problems in which it is not possible to obtain sufficient low temperature fixing property, and the crystalline ester compound is liberated to be exposed to the surface of toner particles, the charging of the toner is lowered and thus an image failure such as a decrease in image density or fogging occurs.

In order to solve such problems, it is proposed that by the control of the compatibility between a binder resin and a crystalline ester compound, the crystalline ester compound is caused to exist in a crystallized state in toner particles, and the crystalline ester compound and the binder resin are made compatible with each other at the time of heat fixing, with the result that both low-temperature fixing property and long-term stability of charging are obtained (see Patent Literatures 2 and 3).

However, in fact, with the toner as described above, it is not possible to sufficiently satisfy the requests for low-temperature fixing property, heat-resistant storability and long-term stability of charging, which are being increasingly made.

CITATION LIST

Patent Literature

[Patent Literature 1] Japanese Patent Application Laid-Open No. 2001-222138

[Patent Literature 2] Japanese Patent Application Laid-Open No. 2004-286842

[Patent Literature 3] Japanese Patent Application Laid-Open No. 2011-149999

SUMMARY OF THE INVENTION

The present invention is made in view of the foregoing conditions; an object of the present invention is to provide a toner for electrostatic-image development that can obtain excellent low-temperature fixing property, heat-resistant storability and long-term stability of charging.

According to the present invention, there is provided a toner for electrostatic-image development that is formed with toner particles containing a binder resin and a crystalline ester compound, wherein the crystalline ester compound has a linear-chain structure, and the binder resin contains a styrene-acrylic resin including a structural unit derived from an acrylic ester monomer represented by the general formula (1) described below: General formula (1)

General formula (1)

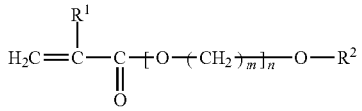

[in the general formula (1), $R^1$ represents a hydrogen atom or a methyl group, $R^2$ represents a hydrogen atom, an alkyl group having 1 to 16 carbon atoms or an aryl group having 6 to 15 carbon atoms. m represents an integer of 2 or 3 and n represents an integer of 1 to 25.]

In the toner for electrostatic-image development according to the present invention, a content of the structural unit derived from the acrylic ester monomer represented by the general formula (1) in the styrene-acrylic resin preferably falls within a range of 2 to 20% by mass.

In the toner for electrostatic-image development according to the present invention, in the general formula (1), $R^1$ is preferably a methyl group.

In the general formula (1), $R^2$ is preferably a methyl group.

In the general formula (1), m is preferably 2.

In the general, formula (1), n is preferably an integer of 2 to 20.

In the general formula (1), n is preferably an integer of 2 to 15.

In the general formula (1), n is preferably an integer of 5 to 13.

In the toner for electrostatic-image development according to the present invention, a content of the crystalline ester compound in the toner particles is preferably 1 to 30% by mass.

In the toner for electrostatic-image development according to the present invention, the crystalline ester compound is preferably a compound having two or more ester bonds, and is more preferably a crystalline polyester resin having four or more ester bonds.

In the toner for electrostatic-image development according to the present invention, the crystalline ester compound preferably has a melting point that is equal to or more than 60° C. and less than 90° C.

In the toner for electrostatic-image development according to the present invention, when a solubility parameter value (SP value: $(cal/cm^3)^{1/2}$) of the crystalline ester compound is set to SP(E), and a solubility parameter value of the binder resin is set to SP(resin), $0<SP(resin)-SP(E)\leq 2.0$ is preferably satisfied.

In the toner for electrostatic-image development according to the present invention, the toner particles preferably contain a wax having a composition different from a composition of the crystalline ester compound.

Preferably, in the toner for electrostatic-image development according to the present invention, when a solubility parameter value (SP value: $(cal/cm^3)^{1/2}$) of the crystalline ester compound is SP(E) and a solubility parameter value of the wax is SP(W), SP(W)<SP(E) is satisfied.

In the toner for electrostatic-image development according to the present invention, when a melting point of the crystalline ester compound is set to Tm(E), and a melting point of the wax is set to Tm(W), Tm(W)<Tm(E) is preferably satisfied.

Effects of the Invention

According to the toner of the present invention, the toner is formed with toner particles containing a binder resin and a crystalline ester compound, and a styrene-acrylic resin composed of the binder resin includes a structural unit derived from an acrylic ester monomer represented by the general formula (1) described above, and thus it is possible to obtain excellent low temperature fixing property, heat-resistant storability and long-term stability of charging.

Hereinafter, the present invention will be specifically described.

[Toner]

The toner of the present invention is formed with toner particles containing a binder resin and a crystalline ester compound, and the binder resin contains a styrene-acrylic resin (hereinafter also referred to as a "specific styrene-acrylic resin") including a structural unit (hereinafter also referred to as an "ethylene(propylene)glycol chain-containing structural unit") derived from an acryl acid ester monomer (hereinafter also referred to as an "ethylene(propylene)glycol chain-containing monomer") represented by the general formula (1) described above, and the crystalline ester compound has a linear-chain structure.

The specific styrene-acrylic resin is contained in the binder resin, and thus it is possible to obtain low-temperature fixing property, heat-resistant storability and long-term stability of charging.

This is probably because the crystalline ester compound exists in a crystallized state in the binder resin of the toner particles before heat fixing, and the crystalline ester compound becomes compatible with the specific styrene-acrylic resin in the binder resin at the time of heat fixing.

Specifically, an ethylene(propylene)glycol chain introduced into the specific styrene-acrylic resin has a high affinity for an ester binding portion of the crystalline ester compound.

It is estimated that, in the toner particles before heat fixing, since the crystalline ester compound has a linear-chain structure, the formation of a structure in which the ethylene (propylene)glycol chain enters the crystal portion of the crystalline ester compound causes crystallization.

Accordingly, within the toner particles, the domains of the crystalline ester compound are uniformly dispersed, and thus the crystalline ester compound can be reliably caused to exist in a crystallized state within the toner particles. Therefore, the crystalline ester compound is prevented from being liberated and exposed to the surface of the toner particles, with the result that heat-resistant storability is obtained and the decrease in charging is prevented over a long period of time. In contrast, it is estimated that, since, at the time of heat fixing, the structure in which the ethylene(propylene)glycol chain enters the crystal portion of the crystalline ester compound is uniformly formed in the toner, when the crystalline ester compound melts at about its melting point, this portion functions as a trigger to rapidly and uniformly facilitate the plasticity of the binder resin, and thus it is possible to obtain excellent low-temperature fixing property.

[Binder Resin]

The binder resin for the toner of the present invention may contain another resin as long as it contains the specific styrene-acrylic resin.

[Specific Styrene-Acrylic Resin]

The specific styrene-acrylic resin including the binder resin contains the ethylene(propylene)glycol chain-containing structural unit derived from the ethylene(propylene)glycol chain-containing monomer represented by the general formula (1) described above.

The specific styrene-acrylic resin may be, for example, a styrene-acrylic resin including a copolymer of the ethylene (propylene)glycol chain-containing monomer represented by the general formula (1) described above and another monomer, or may be a styrene-acrylic resin including a mixture resin of the copolymer formed with the ethylene(propylene) glycol chain-containing monomer and another monomer and a (co)polymer formed with a monomer excluding the ethylene(propylene)glycol chain-containing monomer.

In general formula (1) described above representing the ethylene(propylene)glycol chain-containing monomer, $R^1$ represents a hydrogen atom or a methyl group, and, in particular, it preferably represent a methyl group.

Furthermore, $R^2$ represents a hydrogen atom or an alkyl group having 1 to 16 carbon atoms or an aryl group having 6 to 15 carbon atoms, and, in particular, they preferably represent a methyl group.

Furthermore, in the general formula (1) described above, m represents 2 or 3, and in particular, m is preferably 2.

Moreover, in the general formula (1) described above representing the ethylene(propylene)glycol chain-containing monomer, n represents an integer of 1 to 25, is preferably an integer of 2 to 20, is more preferably an integer of 2 to 15 and is particularly preferably an integer of 5 to 13.

A repetition indicating the length of the ethylene(propylene)glycol chain falls within the above range, and thus it is possible to reliably obtain an interaction between the ethylene (propylene)glycol chain and the crystalline ester compound.

A ethylene(propylene)glycol chain-containing structural unit content in the specific styrene-acrylic resin, that is, a ratio of the ethylene(propylene)glycol chain-containing monomer thereto, is preferably 2 to 20% by mass and is more preferably 3 to 15% by mass.

The ethylene(propylene)glycol chain-containing structural unit content in the specific styrene-acrylic resin falls within the above-described range, and thus the crystalline ester compound reliably has a high affinity for the specific styrene-acrylic resin, these become compatible at the time of heat fixing and it is possible to reliably obtain the effect of facilitating the plasticity of the binder resin. In contrast, when the ethylene(propylene)glycol chain-containing structural unit content in the specific styrene-acrylic resin is significantly high, the glass-transition temperature of the binder resin is low, and it may not be possible to obtain sufficient heat-resistant storability. In addition, when the ethylene(propylene)glycol chain-containing structural unit content in the specific styrene-acrylic resin is significantly low, it may not be possible to sufficiently obtain the effect of facilitating the plasticity by the ethylene(propylene)glycol chain, and thus it may not be possible to sufficiently obtain low-temperature fixing property.

Another monomer used for the formation of the specific styrene-acrylic resin is not particularly limited as long as it can copolymerize with the ethylene(propylene)glycol chain-containing monomer to thereby form a styrene-acrylic resin, and examples thereof include:

Styrene and its derivatives styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexy styrene, p-n-octylstyrene, p-n-nonylstyrene, p-n-decylstyrene, p-n-dodecylstyrene, their derivatives and the like. Among these, styrene is used preferably.

Methacrylic acid, methacrylic ester and their derivatives methacrylic acid, methy methacrylate (MMA), ethyl methacrylate (EMA), n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethyl amino ethyl methacrylate, dimethyl amino ethyl methacrylate, their derivatives and the like.

Acrylic acid, acrylic ester and their derivatives acrylic acid, methyl acrylate, ethyl acrylate, isopropyl acrylate, n-butyl acrylate, t-butyl acrylate, isobutyl acrylate, n-octyl acrylate, 2-ethylhexyl-acrylate, stearyl acrylate, lauryl acrylate, phenyl acrylate, their derivatives and the like. Among them, n-butyl acrylate is preferably used.

They can be used alone or in combination of two or more of them.

In addition, the following vinyl polymerizable monomers can also be used together with the styrene monomers and/or the (meth)acrylic monomer described above.

Olefins ethylene, propylene, isobutylene and the like

Vinyl esters

Vinyl propionate, vinyl acetate, vinyl benzoate and the like

Vinyl ethers vinyl methyl ether, vinyl ethyl ether and the like

Vinyl ketones

Vinyl methyl ketone, vinyl ethyl ketone, vinyl hexyl ketone and like

N-vinyl compounds

N-vinyl carbazole, N-vinyl indole, N-vinyl pyrrolidone and the like

Others vinyl compounds such as vinyl naphthalene and vinyl pyridine and acrylic acid such as acrylonitrile, methacrylonitrile and acrylamide or methacrylic acid derivatives Furthermore, the following polymerizable monomers having an ionic dissociative group such as a carboxyl group or a phosphate group are preferably used together with the styrene monomers and/or the (meth)acrylic monomer described above.

Polymerizable monomer having a carboxyl group acrylic acid, methacrylic acid, α-ethyl acrylate, (meth) acrylic acid such as crotonic acid and α-alkyl derivative or β-alkyl derivative; unsaturated dicarboxylic acids such as fumaric acid, maleic acid, citraconic acid and itaconic acid; unsaturated dicarboxylic acid monoester derivatives such as mono-acryloyloxyethyl ester succinate, mono-acryloyloxyethyl ethylene ester succinate, mono-acryloyloxyethyl ester phthalate, mono-methacryloyloxyethyl ester phthalate and the like Polymerizable monomer having a phosphate group acidophosphooxyethyl methacrylate and the like Furthermore, the following polyfunctional vinyl series are used together with the styrene monomers and/or the (meth) acrylic monomer described above, and thus the binder resin can be made to have a cross-linked structure.

Polyfunctional vinyl ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate and the like The glass-transition temperature of the specific styrene-acrylic resin is preferably 30 to 50° C., and is more preferably 35 to 48° C.

The glass-transition temperature of the specific styrene-acrylic resin falls within the above-described range, and thus it is possible to reliably obtain low-temperature fixing property.

The glass-transition temperature of the specific styrene-acrylic resin was measured through the use of "Diamond DSC" (manufactured by PerkinElmer Co., Ltd.).

In a measurement procedure, 3.0 mg of a specimen (the specific styrene-acrylic resin) was sealed in an aluminum pan and was set in a holder. As a reference, an empty aluminum pan was used. The temperature control is performed through a heating-cooling-heating cycle under the measurement conditions of a measurement temperature of 0° C. to 200° C., a temperature increase rate of 10° C./min and a temperature decrease rate of 10° C./min. Analysis was performed on the basis of data in the 2nd heating, and the extension of a base line before the rise of a first endothermic peak and a tangential line representing the maximum inclination between the rising portion of the first peak and the top of the peak are drawn, and their intersection is shown as the glass transition point.

In addition, in order for the toner to have low-temperature fixing property, the softening point of the specific styrene-acrylic resin is preferably 80 to 120° C., and is more preferably 90 to 110° C.

The softening point of the specific styrene-acrylic resin is measured through the use of a flow tester described below.

Specifically, 1.1 g of the specific styrene-acrylic resin is first placed in a petri dish under an environment of 20° C. and 50% RH and then is leveled off. After being left for 12 hours or longer, pressurizing of the specific styrene-acrylic resin is performed using a press "SSP-10A" (manufactured by Shimadzu Corporation) at a pressure of 3,820 kg/cm$^2$ for 30 seconds, to thereby produce a cylindrical molded sample having a diameter of 1 cm, and then, the molded sample is placed in the flow tester "CFT-500D" (manufactured by Shimadzu Corporation) under an environment of 24° C. and 50% RH. Under the conditions of a load of 196 N (20 kgf), a start temperature of 60° C., a preheating time of 300 seconds, and a temperature increase rate of 6° C./min. the molded sample is extruded from the hole (1 mm diameter×1 mm) of a cylindrical die by using a piston having a diameter of 1 cm after completion of preheating. An offset method temperature $T_{offset}$ measured by a melting temperature measurement method of a temperature rising method with an offset value being set to 5 mm is used as the softening temperature of the specific styrene-acrylic resin.

Furthermore, the weight-average molecular weight (Mw) of the specific styrene-acrylic resin is preferably 10,000 to 50,000, and is more preferably 25,000 to 35,000.

The weight-average molecular weight (Mw) of the specific styrene-acrylic resin falls within the above-described range, and thus it is possible to reliably obtain low-temperature fixing property and fixing separation property. In contrast, when the weight-average molecular weight (Mw) of the specific styrene-acrylic resin is significantly high, it may not be possible to sufficiently obtain low-temperature fixing property. Moreover, when the weight-average molecular weight (Mw) of the specific styrene-acrylic resin is significantly low, it may not be possible to sufficiently obtain fixing separation property.

The weight-average molecular weight (Mw) of the specific styrene-acrylic resin is measured by gel permeation chromatography (GPC).

Specifically, the weight-average molecular weight (Mw) is measured using an apparatus "HLC-8220" (manufactured by TOSOH Corporation) and a column "TSK guard column+TSK gel Super HZM-M three in series" (manufactured by TOSOH Corporation) in the flow of tetrahydrofuran (THF) used as a carrier solvent at a flow rate of 0.2 ml/min while the temperature of the column is held at 40° C. A specimen (the specific styrene-acrylic resin) is dissolved in THF at room temperature for 5 minutes by using an ultrasonic disperser so as to have a concentration of 1 mg/ml. Then, a specimen solution is obtained by treatment through a membrane filter having a pore size of 0.2 μm, and 10 μL of the specimen solution together with the above-described carrier solvent is injected into the apparatus. Detection is performed using a refractive index detector (RI detector), and the molecular weight distribution of the measurement specimen is calculated using a calibration curve determined using monodispersed polystyrene standard particles. Ten different types of polystyrene are used for the measurement of the calibration curve.

Other resin that may be contained in the binder resin of the toner of the present invention is preferably a polyester resin or the like, and examples thereof include a vinyl resin such as an olefin resin, a polyamide resin, a polycarbonate resin, a polyether resin, a polyvinyl acetate resin, a polysulfone resin, an epoxy resin, a polyurethane resin, a urea resin and the like. The other resins can be used alone or in combination of two or more of them.

A content of each of the other resins in the binder resin is preferably 0 to 50% by mass.

As the solubility parameter value SP(resin) of the binder resin contained in the toner of the present invention, a solubility parameter value that is higher than the solubility parameter value SP(E) of the crystalline ester compound is preferably used, and a solubility parameter value that satisfies $0<SP(resin)-SP(E)\leq 2.0$ is preferably used. Both the solubility parameter values are close to each other, and thus it is possible to obtain a high affinity between the crystalline ester compound and the ethylene(propylene)glycol chain, to reliably obtain the effect of facilitating the plasticity of the binder resin by the crystalline ester compound and to obtain significantly excellent low temperature fixing property. When the solubility parameter value SP(resin) of the binder resin is equal to or less than the solubility parameter value SP(E) of the crystalline ester compound, it may not be possible to sufficiently obtain an affinity between the crystalline ester compound and the ethylene(propylene)glycol chain at the time of heat fixing. Specifically, the solubility parameter value SP(resin) of the binder resin is preferably 10.1 to 10.3.

Meanwhile, when the toner particles including the toner of the present invention have a core shell structure in which the surface of core particles is coated with a shell, layer, the crystalline ester compound is preferably contained in the core particles, and in this case, the solubility parameter value SP(resin) of the binder resin refers to the solubility parameter value of the resin including the core particles.

In the present invention, the solubility parameter value (SP value: $(cal/cm^3)^{1/2}$) is a solubility parameter value at 25° C., is a specific value of a substance, and is a useful standard for predicting the solubility of the substance. The higher the SP value is, the higher the polarity is, whereas the lower the value is, the lower the polarity is. When two types of substances are mixed, the lower the difference between their SP values is, the higher the solubility is.

The SP value of the binder resin is calculated as a product of the SF value of each of monomers forming the binder resin and a molar ratio. For example, when the binder resin is assumed to be formed with two types of monomers, X and Y, and if the mass ratios of the respective monomers are set to x and y (% by mass), the molecular weights are set to Mx and My and the SP values are set to SPx and SPy, the SP value of the binder resin is represented by formula (1) below.

$$SP=\{(x\times SPx/Mx)+(y\times SPy/My)\}\times\{1/(x/Mx+y/My)\} \quad \text{Formula (1):}$$

The SP value of the monomer is calculated from formula (2) described below, after an evaporation energy ($\Delta_{ei}$) and a molar volume ($\Delta_{vi}$) are obtained from "Polym. Eng. Sci. Vol 114, p 114 (1974)" proposed, by Fedors, for atoms or atom groups within the molecular structure of the monomer. However, with respect to a double bond that is cleaved at the time of polymerization, its cleaved state is assumed to be its molecular structure.

$$\sigma=(\Sigma\Delta_{ei}/\Sigma\Delta_{vi})^{1/2} \quad \text{Formula (2):}$$

When the SP value of the monomer cannot be calculated by formula (2) above, as a specific value, a document such as "Polymer Handbook" ver. 4 (published by Wiley Co. Ltd.) or an item on solubility parameter (http://polymer.nims.go.jp/guide/guide/p5110.html) described in a database "PolyInfo" (http://polmyer.nims.go.jp) provided by an independent administrative agency "National Institute for Materials Science" can be referenced.

[Crystalline Ester Compound]

The crystalline ester compound contained in the toner particles of the present invention acts as a plasticizer mainly for the binder resin at the time of heat fixing depending on a height of affinity between the crystalline ester compound and the ethylene(propylene)glycol chain of the specific styrene-acrylic resin, and functions as a fixing aid that contributes to low-temperature fixing property.

The crystalline ester compound has a linear-chain structure. In the present invention, the crystalline ester compound having a linear-chain structure refers to a crystalline ester compound having a structure in which all carbon chains are linear.

As the crystalline ester compound, a crystalline ester compound having two or more ester bonds is preferably used, and specific examples thereof include a fatty acid diester compound, a crystalline polyester resin having three or more ester bonds and the like. Among them, a crystalline polyester resin having four or more ester bonds is preferably used probably because the number of ester bonds is large and thus the strong interaction with the ethylene(propylene)glycol chain of the specific styrene-acrylic resin is obtained, and the strong compatibility at the time of heat fixing is obtained.

In the present invention, the crystalline ester compound is a compound that does not have a stepwise change in differential scanning calorimetry (DSC) but has a clear endothermic peak. Specifically, the clear endothermic peak means a peak in which, when a measurement is made at a temperature increase rate of 10° C./min in differential scanning calorimetry (DSC), the half-value width of an endothermic peak fails within a range of 15° C. or less.

Specific examples of a monoester compound include stearyl stearate, behenyl stearate, behenyl behenate, behenyl palmitate, arachidic acid behenyl, tetracosanoic acid stearyl, hexacosanoic acid stearyl and the like.

Specific examples of an aliphatic diester compound include distearyl adipic acid, ethylene glycol distearate, dibehenyl succinate, distearyl succinate, dibehenyl adipic acid, sebacic acid distearyl, ethylene glycol dibehenate, 1,4-butanediol distearate, 1,4-butanediol dibehenate, 1,6-hexanediol distearate, 1,6-hexanediol dibehenate and the like.

In addition, the crystalline polyester resin can be generated from a dicarboxylic acid component and a diol component. As the dicarboxylic acid component, an aliphatic dicarboxylic acid having a linear-chain structure is used. The dicarboxylic acid component is not limited to one type, and a combination of two or more types may used. In addition, as the diol component, an aliphatic diol having a linear-chain structure is used and may contain a diol other than an aliphatic diol, as necessary. The diol component is not limited to one type, and a combination of two or more types may be used.

Examples of the aliphatic dicarboxylic acid include oxalic acid, malonic acid, succinic acid, glutaric acid, adipic acid, pimelic acid, suberic acid, azerin acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid and the like. Their acid anhydrides can also be used.

Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-dodecanediol, 1,11-undecanediol, 1,12-dodecanediol, 1,13-tridecanediol, 1,14-tetradecanediol, 1,18-octadecanediol, 1,20-eicosanoic acid diol and the like. Among them, ethylene glycol, 1,4-butanediol, 1,6-hexanediol, 1,9-nonanediol and 1,10-decanediol are preferably used.

Examples of dials other than the aliphatic diol include a diol having a double bond, a diol having a sulfonic acid group and the like, and specific examples thereof include 2-butene-1,4-diol, 3-hexene-1,6-diol, 4-octene-1,8-diol and the like.

An aliphatic diol content in the diol component for forming the crystalline polyester resin is preferably 80 constituent mole % or more and is more preferably 90 constituent mole % or more. The aliphatic diol content in the diol component is set to 80 constituent mole % or more, and thus it is possible to ensure the crystallinity of the crystalline polyester resin.

In a usage ratio between the diol component and the dicarboxylic acid component described above, an equivalent ratio [OH]/[COOH] between the hydroxyl group [OH] of the diol component and the carboxyl group [COOH] of the dicarboxylic acid component is preferably 1.5/1 to 1/1.5, and is more preferably 1.2/1 to 1/1.2.

The usage ratio between the diol component and the dicarboxylic acid component falls within the above-described range, and thus it is possible to reliably obtain a crystalline polyester resin having a desired molecular weight.

The weight-average molecular weight (Mw) of the crystalline polyester resin measured by gel permeation chromatography (GPC) is preferably 1,000 to 50,000, and is more preferably 2,000 to 30,000.

The weight-average molecular weight (Mw) of the crystalline polyester resin is measured using the crystalline polyester resin as a measurement specimen in the same manner as described above.

In the crystalline ester compound of the present invention, depending on the type of binder resin to be used, when its solubility parameter value ($(cal/cm^3)^{1/2}$) is assumed to be SP(E), the compound having SP(E) of 8.5 to 10.5 is preferably used, and the compound having SP(E) of 9.0 to 10.2 is more preferably used.

The solubility parameter value SP(E) of the crystalline ester compound falls within the above-described range, and thus it is possible to obtain a high affinity between the crystalline ester compound and the ethylene(propylene)glycol chain and to reliably obtain the effect of facilitating the plasticity of the binder resin at the time of heat fixing.

When the melting point of the crystalline ester compound is assumed to be Tm(E), Tm(E) is preferably equal to or more than 50° C. and less than 120° C., and is more preferably equal to or more than 60° C. and less than 90° C.

The melting point of the crystalline ester compound falls within the above-described range, and thus it is possible to reliably obtain low-temperature fixing property and fixing separation property. In contrast, when the melting point of the crystalline ester compound is significantly low, it may not be possible to satisfactorily obtain excellent fixing separation property, whereas, when the melting point of the crystalline ester compound is significantly high, it may not be possible to sufficient low-temperature fixing property.

Specifically, the melting point of the crystalline ester compound is measured, using "Diamond DSC" (manufactured by PerkinElmer Co., Ltd.) as a differential scanning calorimeter, under measurement conditions (temperature increase and cooling conditions) which undergo, in the following order, the first temperature increase process in which the temperature is increased from 0° C. to 200° C. at a temperature increase rate of 10° C./min, a cooling process in which the temperature is cooled from 200° C. to 0° C. at a cooling rate of 10° C./min and the second temperature increase process in which the temperature is increased from 0° C. to 200° C. at a temperature increase rate of 10° C./min. On the basis of a DSC curve obtained by this measurement, an endothermic peak top temperature derived from the crystalline ester compound in the first temperature increase process is assumed to be the melting point. In the measurement procedure, 3.0 mg of the crystalline ester compound was sealed in an aluminum pan and was set in a Diamond DSC sample holder. As a reference, an empty aluminum pan was used.

A crystalline ester compound content in the toner particles is preferably 1 to 30% by mass, and is more preferably 5 to 20% by mass.

The crystalline ester compound content falls within the above-described range, and thus it is possible to reliably obtain both sufficient low-temperature fixing property and heat-resistant storability. When the crystalline ester compound content is significantly high, the binder resin is significantly softened, and thus the heat-resistant storability of the toner may be degraded. When the crystalline ester compound content is significantly low, it may not be possible to obtain sufficient low-temperature fixing property.

[Wax]

In the toner particles of the present invention, a wax having a composition different from that of the crystalline ester compound, other than the binder resin and the crystalline ester compound is contained as an internal additive.

This wax functions as a mold release agent that facilitates fixing separation property and the like.

When the solubility parameter value ($(cal/cm^3)^{1/2}$) of the wax described above is assumed to be SP(W), a wax preferably satisfies SP(W)<SP(E), and specifically, the difference between them is preferably 0.1 or more.

The wax and the crystalline ester compound satisfy the above-described relationship, and thus it is possible to reliably obtain both the mold release property by the wax and the effect of facilitating the plasticity of the binder resin by the crystalline ester compound.

Although the solubility parameter value SP(W) of the wax differs depending on the solubility parameter value SP(E) of the crystalline ester compound to be used together, specifically, it preferably falls within a range of 8.1 to 8.9, and it more preferably falls within a range of 8.1 to 8.7. The solubility parameter value SP(W) of the wax fails within the above-described range, and thus it is possible to achieve satisfactory mold release property at the time of heat fixing. In contrast, when the solubility parameter value SP(W) of the wax is significantly low, there is a possibility that it is not possible to retain the crystalline ester compound in the binder resin, thereby producing bleeding and thus it is not possible to obtain sufficient heat-resistant storability, or a possibility that an image failure is produced by contamination within the device, whereas, when the solubility parameter value SP(W) of the wax is significantly high, and a possibility that it is not possible to obtain sufficient mold release property and thus it is not possible to sufficiently obtain fixing separation property.

When the melting point of the wax is assumed to be Tm(W), the wax preferably satisfies Tm(W)<TM(E), and specifically, Tm(W) is preferably equal to or more than 50° C. and less than 120° C., and is more preferably equal to or more than 60° C. and less than 90° C.

By using the wax satisfying Tm(W)<TM(E), the wax first seeps at the time of heat fixing and then the crystalline ester compound melts to facilitate the plasticity of the binder resin, and thus it is possible to obtain excellent fixing separation and hot offset resistance.

Through the use of the wax whose melting point falls within the above-described range, heat-resistant storability is ensured in the obtained toner and stable low-temperature fixing property is obtained. In contrast, wen the melting point of the wax is significantly low, there is a possibility that bleeding is generated and thus it is not possible to obtain sufficient heat-resistant storability in the toner, whereas, when the melting point of the wax is significantly high, there is a possibility that it is not possible to melt the wax sufficiently ahead of the crystalline ester compound and thus it is not possible to satisfactorily obtain excellent fixing separation property.

The melting point of the wax is measured as described above using a measurement specimen as the wax.

The wax is not particularly limited as long as it is different from the crystalline ester compound, and specific examples include: polyolefin waxes such as a polyethylene wax and a polypropylene wax; branched hydrocarbon wax such as a microcrystalline wax; long chain hydrocarbon waxes such as a paraffin wax, a Sasol wax; dialkyl ketone waxes such as a distearyl ketone; carnauba wax; montan wax; ester waxes such as stearyl stearate, behenyl stearate, behenyl behenate, behenyl palmitate, arachidic: acid behenyl, tetracosanoic acid stearyl, hexacosanoic acid stearyl, trimethylolpropane tribehenate, pentaerythritol tetra behenate, pentaerythritol diacetate dibehenate, glycerin tribehenate, 1,18-octadecanediol distearate, trimellitic acid tristearyl and distearyl maleate; amide waxes such as ethylenediamine behenyl amide, trimellitic acid tristearyl amide; and the like. They can be used alone or in combination of two or more of them.

Among them, a hydrocarbon wax is preferably used.

A wax content in the toner particles is preferably 1 to 30% by mass, and is more preferably 5 to 20% by mass. The wax content falls within the above-described range, and thus it is possible to sufficiently obtain fixing separation property. When the wax content is significantly high, the toner particles are significantly softened, and thus the heat-resistant storability of the toner may be degraded.

The total amount of the crystalline ester compound and the wax contained in the toner particles of the present invention is preferably 2 to 40% by mass, and is more preferably 5 to 30% by mass.

When the total amount of the crystalline ester compound and the wax contained therein is significantly low, it may not be possible to obtain sufficient mold release property and low-temperature fixing property, whereas, when the total amount of the crystalline ester compound and the wax contained therein is significantly high, it may not be possible to obtain sufficient heat-resistant storability in the toner because of the generation of bleeding.

In addition, the mass ratio A/B between the wax and the crystalline ester compound is preferably 30/70 to 80/20, and is more preferably 40/60 to 70/30.

When the mass ratio of the wax to the crystalline ester compound is significantly low, it may not be possible to sufficiently obtain mold release property. When the mass ratio of the wax to the crystalline ester compound is significantly high, it may not be possible to obtain sufficient low-temperature fixing property.

In the toner particles of the present invention, other than the binder resin and the crystalline ester compound, internal additives such as a colorant, a charge control agent and the like may be contained as necessary.

[Colorant]

As a colorant, commonly known dyes and pigments can be used.

As a colorant for obtaining a black toner, known various types of colorants such as carbon blacks including a furnace black and a channel black, magnetic materials including a magnetite and a ferrite, an inorganic pigment containing a dye and a non-magnetic iron oxide can be arbitrarily used.

As a colorant for obtaining a color toner, known colorants such as dyes and organic pigments can be arbitrarily used, and specifically, examples of the organic pigment include C. I. Pigment Red: 5, 48:1, 53:1, 57:1, 81:4, 122, 139, 144, 149, 166, 177, 178, 222, 238 and 269, C. I. Pigment Yellow: 34, 17, 74, 93, 94, 138, 155, 180 and 185, C. I. Pigment Orange: 31 and 43 and C. I. Pigment Blue: 15:3, 60 and 76. Examples of the dye include C. I. Solvent red: 1, 49, 52, 58, 68, 11 and 122, C. I. Solvent Yellow: 19, 44, 77, 79, 81, 82, 93, 98, 103, 104, 112 and 162, C. I. Solvent Blue: 25, 36, 69, 70, 93 and 95, and the like.

Colorants for obtaining the toner of each color can be used alone or in combination of two or more of them, for each color.

A colorant content in the toner particles is preferably 1 to 10% by mass, and is more preferably 2 to 8% by mass.

[Charge Control Agent]

As the charge control agent, known various types of compounds can be used.

A charge control agent content in the toner particles with respect to the binder resin is normally 0.1 to 10% by mass, and preferably 0.5 to 5% by mass.

[Softening Point of the Toner]

In order for the toner to have low-temperature fixing property, the softening point of the toner is preferably 80 to 120° C. and is more preferably 90 to 110° C.

The softening point of the toner falls within the above-described range, and thus it is possible to reliably obtain low-temperature fixing property and fixing separation property.

The softening point of the toner is measured using toner as a specimen in the same manner as described above.

[Average Particle Diameter of the Toner]

The average particle diameter of the toner according to the present invention is preferably 3 to 9 μm, and is more preferably 3 to 8 μm, for example, in terms of a volume-based median diameter. For example, when the toner is manufactured by adopting an emulsification aggregation method, which will be described later, it is possible to control the particle diameter depending on the concentration of a aggregating agent to be used, the amount of organic solvent to be added, a fusion time and the composition of a polymer.

The volume-based median diameter falls within the above-described range, and thus the transfer efficiency is increased, and the quality of a halftone image is enhanced, with the result that the image quality of fine lines and dots is enhanced.

The volume-based median diameter of the toner is measured and calculated using a measuring device in which a computer system into which data processing software "Software V3.51" is installed is connected to "Multisizer 3" (manufactured by Beckman Coulter, Inc.).

Specifically, 0.02 g of a specimen (the toner; is added to 20 mL of a surfactant solution (for example, a surfactant solution obtained by diluting a neutral detergent containing a surfactant component, with pure water, to 10 times for the purpose of dispersing the toner particles) to cause the specimen to be spread therein, and then ultrasonic dispersion is performed for 1 minute to prepare a toner dispersion liquid. This resultant toner dispersion liquid is added, with a pipette, to a beaker containing "ISOTON II" (manufactured by Beckman Coulter, Inc) within a sample stand until the concentration displayed in the measuring device reaches 8%. Here, by using the above-described concentration range, a reproducible measurement value can be obtained. Then, in the measuring device, the measurement number of particles to be counted is set to 25,000, and the diameter of an aperture is set to 50 μm. The range of measurement from 1 to 30 μm is divided into 256 sections, and a frequency value is calculated. The particle size when a cumulative volume fraction cumulated from the largest volume fraction is 50% is used as the volume-based median diameter.

[Average Degree of Circularity of the Toner]

From the viewpoint of enhancement of the transfer efficiency, the average degree of circularity of the toner according to the present invention is preferably 0.930 to 1.000, and is more preferably 0.950 to 0.995.

In the present invention, the average degree of circularity of the toner is measured through the use of "FPFIA-2100" (manufactured by Sysmex Corporation).

Specifically, a specimen (the toner) is spread in an aqueous solution containing a surfactant, and is dispersed by being subjected to ultrasonic dispersion processing for 1 minute, thereafter shooting is performed with "FPIA-2100" (manufactured by Sysmex Corporation) in a measurement condition HPF (high magnification imaging) mode at an appropriate concentration in which the HPF detection number is 3,000 to 10,000, the degree of circularity of each toner particle is calculated according to the following formula (T), the degrees of circularity of the toner particles are added and the resulting value is divided by the total number of toner particles, with the result that the average degree of circularity of the toner is measured.

Degree of circularity=(Circumference of a circle having the same projection area as a particle image)/(Circumference of a particle projection image) Formula (T):

[Method of Manufacturing the Toner]

A method of manufacturing the toner of the present invention is not particularly limited, and examples thereof include known methods such as a kneading-pulverizing method, a suspension polymerization method, an emulsion aggregation method, a dissolution suspension method, a polyester elongation method and a dispersion polymerization method.

Among them, it is preferable to adopt the emulsion aggregation method from the viewpoint of the uniformity of particle diameters which is highly advantageous in high image quality and the high stability of charging, the controllability of the shape and the ease of formation of a core shell structure.

The emulsion aggregation method is a method in which a dispersion liquid of minute particles (hereinafter also referred to as "resin particles") of the binder resin dispersed by a surfactant and a dispersion stabilizer is mixed, as necessary, with a dispersion liquid of toner particle constituent components such as the minute particles of the colorant, and is aggregated by addition of an aggregation agent until a desired toner particle diameter is obtained, thereafter or at the same time when the aggregation occurs, the resin minute particles are fused, the shape is controlled and thus the toner particles are formed.

Here, as the resin minute particles, composite particles formed with a plurality of layers composed of two or more layers of resins having different compositions can be used.

The resin minute particles can be manufactured by, for example, an emulsion polymerization method, a mini-emulsion polymerization method or a phase-transfer emulsification method or can be manufactured by combining several manufacturing methods. When an internal additive is contained in the resin minute particles, the mini-emulsion polymerization method, among them, is preferably used.

When an internal additive is contained in the resin minute particles, the resin minute particles may contain the internal additive or a dispersion liquid of internal additive minute particles consisting only of the internal additive may be prepared separately and the internal additive minute particles may be aggregated together when the resin minute particles are aggregated.

In addition, when the toner particles are configured to have a core shell structure, the resin minute particles having different compositions are preferably added and aggregated with different timing at the time of aggregation.

A method of introducing a specific styrene-acrylic resin into the toner particles of the present invention will be specifically described below.

In the emulsion aggregation method, the specific styrene-acrylic resin has only to be introduced into any of the aggregated resin minute particles, and when the resin minute particles are formed with composite particles having two or more layers, the specific styrene-acrylic resin may be introduced into any of the layers of the composite particles.

In the emulsion aggregation method, together with the resin minute particles into which the specific styrene-acrylic resin has been introduced, the resin minute particles formed with a resin not including the specific styrene-acrylic resin may be aggregated. In addition, the resin minute particles into which the specific styrene-acrylic resin has been introduced may be added during the aggregation with any timing from the beginning to the end of the aggregation, or the addition may be performed by being divided into a plurality of times.

Preferably, in the kneading-pulverizing method, the specific styrene-acrylic resin ray be kneaded alone or together with another resin.

In addition, as a method of introducing the crystalline ester compound into the toner particles of the present invention, for example, when the emulsion aggregation method is used to manufacture the toner, the mini-emulsion polymerization method of introducing the crystalline ester compound into the aggregated resin minute particles is preferably used, whereas, when the resin minute particles are formed with the composite particles having two or more layers, the crystalline ester compound may be introduced into any of the layers of the composite particles.

Furthermore, the minute particles of the crystalline ester compound are produced by the phase-transfer emulsification method or the like, and are aggregated together with the resin minute particles, and thus the crystalline ester compound can also be introduced.

[External Additives]

Although the toner particles of the present invention can be used as toner particles without being processed, from the viewpoint of enhancing the charging performance, the flowability or the cleaning performance of the tone, particles such as known inorganic minute particles and organic minute particles and a lubricant can be added as external additives to the surface of the toner particles.

The inorganic minute particles preferably include inorganic minute particles of silica, titania, alumina, strontium titanate and the like.

These inorganic minute particles may be subjected to hydrophobization processing, as necessary.

As the organic minute particles, spherical organic minute particles having a number-average primary particle diameter of about 10 to 2000 nm can be used. Specifically, organic minute particles of a homopolymer such as styrene or methyl methacrylate or of a copolymer thereof can be used.

The lubricant is used in order to further enhance the cleaning performance and transferability, and examples of the lubricant include metal salts of higher fatty acids such as: salts of zinc, aluminum, copper, magnesium, calcium and the like of stearic acid; salts of zinc, manganese, iron, copper, magnesium and the like of oleic acid; salts of zinc, copper, magnesium, calcium and the like of palmitic acid; salts of zinc, calcium and the like of linoleic acid; and salts of zinc, calcium and the like of ricinoleic acid. A combination of various types of these external additives may be used.

The amount of external additive added to the toner particles is 0.1 to 10.0% by mass.

Examples of a method of adding the external additive include methods of adding the external additive by using known various types of mixing devices such as a tubular mixer, a Henschel mixer, a Nautamixer and a V-type mixer.

[Developer]

The toner of the present invention can be used as a magnetic or non-magnetic one-component developer, but may also be mixed with a carrier to be used as a two-component developer.

When the toner is used as a two-component developer, the amount of the toner mixed with the carrier is preferably 2 to 10% by mass.

No particular limitation is imposed on a mixer used to mix the toner and the carrier, and examples of the mixer include a Nautamixer and W-cone and V-type mixers.

In terms of the volume-based median diameter, the average particle diameter of the carrier is preferably 10 to 60 μm.

In the present invention, the volume-based median diameter of the carrier can be measured typically with a laser diffraction-type particle size distribution measuring device "HELOS" (manufactured by SYMPATEC Corp.) provided with a typical wet dispersing device.

Furthermore, as the carrier, a coat carrier in which a magnetic particle is used as a core material (core) and whose surface is coated with a resin is preferably used. The resin used for coating the core material is not particularly limited, and various types of resins can be used. For example, for a positively charged toner, a fluorine resin, a fluorine-acrylic acid resin, a silicone resin, a modified silicone resin and the like can be used, and specifically, a condensation-type silicone resin is preferably used. Furthermore, for example, for a negatively charged toner, a styrene-acrylic resin, a mixture resin of a styrene-acrylic resin and a melamine resin, its curing resin, a silicone resin, a modified silicone resin, an epoxy resin, a polyester resin, a urethane resin, a polyethylene resin and the like can be used. Among them, a mixture resin of a styrene-acrylic resin and a melamine resin, its curing resin or a condensation-type silicone resin is preferably used.

When the toner of the present invention is used as a two-component developer, the two-component developer can also be formed by further adding, to the toner and the carrier, as necessary, a charge control agent, an adhesion enhancement agent, a primer processing agent, a resistance control, agent or the like.

[Image Forming Device]

The toner of the present invention can be used in a general image forming method of an electrophotographic method. As an image forming device for performing this type of image forming method, an image forming device can be used that includes: a photosensitive member that is, for example, an electrostatic latent image carrier; charging means that performs corona discharge having the same polarity as the toner, to thereby apply a uniform potential on the surface of the photoreceptor; exposure means that expose, based on image data, an image onto the surface of the uniformly charged photoreceptor, to thereby form an electrostatic latent image; development means that transports the toner to the surface of the photoreceptor and visualizes the electrostatic latent image to form the toner image; transfer means that transfers, as necessary, the toner image through an intermediate transfer body to an image support; and fixing means that thermally fixes the toner image on the image support.

In addition, the toner of the present invention can be suitably used as a toner of a relatively low-temperature in which a fixing temperature (the surface temperature of a fixing member) is 100 to 200° C.

According to the toner described above, the toner is formed with the toner particles containing the binder resin and the crystalline ester compound, and the ethylene(propylene)glycol chain-containing structural unit is included in the styrene-acrylic resin constituting the binder resin of the toner, and thus it is possible to obtain excellent low temperature fixing property, heat-resistant storability and long-term stability of charging.

As described above, although the embodiment of the present invention has been described, the embodiment of the present invention is not limited to the examples described above, and various modifications are possible.

EXAMPLES

Hereinafter, although specific examples of the present invention will be described, the present invention is not limited to these examples.

The molecular weight and the melting point of the crystalline polyester resin were measured in the same manner as described above.

Synthesis Example A1 of the Crystalline Ester Compound 300 g of 1,10-decanediol, 250 g of 1,10-decanedicarboxylic acid and a catalyst $Ti(OBu)_4$ (0.014% by mass with respect to the carboxylic acid component) were put into a threenecked flask, and then the pressure within the container was reduced by a pressure reduction operation. Furthermore, nitrogen gas was used to keep the container under an inert atmosphere, and reflux was performed at 180° C. for 6 hours by mechanical agitation. Thereafter, an unreacted monomer component was removed by distillation under reduced pressure, the temperature was gradually increased to 220° C. and agitation was performed for 12 hours. When a viscous state was reached, cooling was performed, and thus a crystalline polyester resin [A1] was obtained.

The obtained crystalline polyester resin [A1] had a weight-average molecular weight (Mw) of 17,600 and a melting point of 82° C.

Synthesis Examples [A2] to [A5] of the Crystalline Ester Compound

Crystalline polyester resins [A2] to [A5] were obtained in the same manner as synthesis example A1 of the crystalline polyester resin except that, as carboxylic acid monomers and alcohol monomers, ones shown the following Table 1 were used.

The weight-average molecular weight (Mw), the melting point and the SP value of these resins are shown in Table 1.

Synthesis Example of Crystalline Ester Compound [A6]

64 parts by mass of adipic acid, 236 parts by mass of stearyl alcohol and 0.5 part by mass of dihydroxy bis titanium (triethanolaminate) serving as a condensation catalyst were put into a reaction container provided with a cooling tube, a thermometer, an agitator, a dehydration device and a nitrogen introduction tube were caused to react for 2 hours while generated water was evaporated away and were further caused to react under a reduced pressure of 5 to 20 mm Hg for 3 hours, with the result that distearyl adipic acid (crystalline ester compound [6]) was obtained.

Synthesis Example of Crystalline Ester Compound [A7]

248 g of stearic acid, 27 g of ethylene glycol and 0.5 g of dihydroxy bis titanium (triethanolaminate) serving as a condensation catalyst were put into a reaction container provided with a cooling tube, a thermometer, an agitator, a dehydration device and a nitrogen introduction tube were caused to react for 2 hours while generated water was evaporated away and were further caused to react under a reduced pressure of 5 to 20 mm Hg for 3 hours, with the result that ethylene glycol distearate (crystalline ester compound [7]) was obtained.

Synthesis Example of Crystalline Ester Compound [A8]

170 g of behenic acid, 163 g of behenyl alcohol and 0.5 g of dihydroxy bis titanium (triethanolaminate) serving as a condensation catalyst were put into a reaction container provided with a cooling tube, a thermometer, an agitator, a dehydration device and a nitrogen introduction tube were caused to react for 2 hours while generated water was evaporated away and were further caused to react under a reduced pressure of 5 to 20 mm Hg for 3 hours, with the result that behenyl behanate (crystalline ester compound [8]) was obtained.

Synthesis Example of Crystalline Ester Compound [A9]

500 g of stearic acid, 60 g of pentaerythritol and 0.5 g of dihydroxy bis titanium (triethanolaminate) serving as a condensation catalyst were put into a reaction container provided with a cooling tube, a thermometer, an agitator, a dehydration device and a nitrogen introduction tube were caused to react for 2 hours while generated water was evaporated away and were further caused to react under a reduced pressure of 5 to 20 mm Hg for 3 hours, with the result that pentaerythritol tetrastearate (crystalline ester compound [9]) was obtained.

TABLE 1

| Crystalline ester compound | | | Alcohol | | Melting | SP | Carbon |
|---|---|---|---|---|---|---|---|
| No. | Compound name | Acid component | component | Mw | point (° C.) | value | chain |
| (A1) | Crystalline polyester resin | 1,10-decanedicarboxylic acid | 1,10-decanediol | 17,600 | 82 | 9.4 | Linear chain |
| (A2) | Crystalline polyester resin | Adipic acid | Diethylene glycol | 11,000 | 68 | 10.4 | Linear chain |
| (A3) | Crystalline polyester resin | 1,10-decanedicarboxylic acid | 1,8-octanediol | 9,500 | 72 | 9.5 | Linear chain |
| (A4) | Crystalline polyester resin | Adipic acid | 1,6-hexanediol | 19,500 | 91 | 10.1 | Linear chain |
| (A5) | Crystalline polyester resin | 1,10-decanedicarboxylic acid | Diethylene glycol | 10,500 | 80 | 9.8 | Linear chain |
| (A6) | Distearyl adipic acid | Adipic acid | Stearyl alcohol | 649 | 72 | 8.8 | Linear chain |
| (A7) | Ethylene glycol distearate | Stearic acid | Ethylene glycol | 593 | 75 | 8.9 | Linear chain |
| (A8) | Behenyl behenate | Behenic acid | Behenyl alcohol | 649 | 71 | 8.6 | Linear chain |
| (A9) | Pentaerythritol tetrastearate | Stearic acid | Pentaerythritol | 1202 | 67 | 8.9 | Branch |

Example 1

Production Example 1 of the Toner (1) Preparation of Dispersion Liquid of Core Resin Minute Particles (First Stage Polymerization)

4 g of polyoxyethylene (2) dodecyl ether sodium sulfate and 3000 g of ion exchange water were put into a 5 L reaction container equipped with an agitation device, a temperature sensor, a cooling tube and a nitrogen introduction device, and the internal temperature was increased to 80° C. while they were being agitated at an agitation rate of 230 rpm under a nitrogen current. After the increase of the temperature, a solution obtained by dissolving 10 g of potassium persulfate in 200 g of ion exchange water was added, the liquid temperature was changed to be 75° C., a monomer mixture liquid composed of 568 g of styrene, 164 g of n-butyl acrylate and 68 g of methacrylic acid was dripped over 1 hour and then the resulting solution was polymerized by being heated and agitated at 75° C. for 2 hours, with the result that a dispersion liquid of resin particles [b1] was prepared.

(Second Stage Polymerization)

A solution obtained by dissolving 2 g of polyoxyethylene (2) dodecyl ether sodium sulfate in 3000 g of ion exchange water was put into a 5 L reaction container equipped with an agitation device, a temperature sensor, a cooling tube and a nitrogen introduction device, the temperature was increased to 80° C., a solution obtained by dissolving 42 g (in terms of solid content) of the above-described resin particles [b1], 35 g of a wax "HNP-0190" (manufactured by Nippon Seiro Co., Ltd.) and 70 g of the above-described crystalline polyester resin [A1] in a monomer solution composed of 195 g of styrene, 91 g of n-butyl acrylate, 20 g of methacrylic acid and 3 g of n-octylmercaptan at 80° C. was added and then the resulting solution was mixed and dispersed for 1 hour with a mechanical dispersion machine "CLEARMIX" (manufactured by M Technique Co., Ltd.) having a circulation path, with the result that a dispersion liquid containing emulsified particles (oil droplets) was prepared.

Then, an initiator solution obtained by dissolving 5 g of potassium persulfate in 100 g of ion exchange water was added to the dispersion liquid, and this method was polymerized by being heated and agitated at 80° C. over 1 hour, with the result that a dispersion liquid of resin particles [b2] was prepared.

(Third Stage Polymerization)

Furthermore, a solution obtained by dissolving 10 g of potassium persulfate in 200 g of ion exchange water was added to the dispersion liquid of the resin particles [b2], and a monomer mixture liquid composed of 315 g of styrene, 145 g of n-butyl acrylate, 25 g of the ethylene(propylene)glycol chain-containing monomer (1-1) (see Table 2), 32 g of methacrylic acid and 6 g of n-octylmercaptan was dripped over 1 hour under a temperature condition of 80° C. After the dripping, the resulting solution was polymerized by being heated and agitated for 2 hours, and was cooled to 28° C., with the result that a dispersion liquid of core resin particles [C1] was obtained.

(2) Preparation of Dispersion Liquid of Shell Resin Minute Particles

A surfactant solution obtained by dissolving 2.0 g of polyoxyethylene dodecyl ether sodium sulfate in 3000 g of ion exchange water was put into a reaction container equipped with an agitation device, a temperature sensor, a cooling tube and a nitrogen introduction device, and the internal temperature was increased to 80° C. while it was being agitated at an agitation rate of 230 rpm under a nitrogen current.

An initiator solution obtained by dissolving 10 g of potassium persulfate in 200 g of ion exchange water was added to the solution mentioned above, and a polymerizable monomer mixture liquid obtained by mixing a compound including 564 g of styrene, 140 g of n-butyl acrylate, 96 g of methacrylic acid and 12 g of n-octylmercaptan was dripped over 3 hours. Then after the dripping, this system was polymerized by being heated and agitated at 80° C. over 1 hour, with the result that a dispersion liquid of shell resin particles [S1] was obtained.

(3) Preparation of Dispersion Liquid of Colorant Minute Particles 90 g of dodecyl sodium sulfate was dissolved in 1600 g of ion exchange water while they were being agitated. While this solution was being agitated, 420 g of a carbon black "Regal 330R" (manufactured by Cabot Corporation) was gradually added, and then dispersion processing was performed with an agitation device "CLEARMIX" (manufactured by M Technique Co., Ltd.), with the result that a dispersion liquid [Bk] of colorant minute particles was prepared.

The diameter of the colorant minute particles in the dispersion liquid [Bk] of colorant minute particles was measured through the use of an electrophoretic light scattering photometer "ELS-800" (manufactured by Otsuka Electronics Co., Ltd.), and the resultant diameter was 110 nm.

(4) Formation of Toner Particles (Aggregation/Fusion Process)

360 g of the dispersion liquid (in terms of solid content; of the core resin particles [C1], 1100 g of ion exchange water and 200 g of the dispersion liquid [Bk] of colorant minute particles were put into a 5 L reaction container equipped with an agitation device, a temperature sensor, a cooling tube and a nitrogen introduction device, the liquid temperature was adjusted to be 30° C. and then the pH was adjusted to be 10 by addition of 5 N of aqueous sodium hydroxide. Then, an aqueous solution obtained by dissolving 60 g of magnesium chloride in 60 g of ion exchange water was added at 30° C. for 10 minutes while being agitated. The temperature was held for 3 minutes, then the temperature started to be increased, the temperature of this system was increased to 85° C. over 60 minutes and a particle growth reaction was continued while the temperature of 85° C. was being held. In this state, the diameter of associated particles was measured through the use of "Coulter Multisizer 3" (manufactured by Beckman Coulter, Inc.), when the volume-based median diameter reached 6 μm, the addition of an aqueous solution obtained by dissolving 40 g of magnesium chloride in 160 g of ion exchange water was performed to stop the growth of the particles and furthermore heating and agitation were performed at a liquid temperature of 80° C. over 1 hour in a maturation process, to thereby progress fusion between the particles, with the result that core particles [1] were formed.

(Shelling Process)

Then, 40 g of the shell resin particles [S1](in terms of solid content) was added, agitation was continued at 80° C. over 1 hour and the shell resin particles [S1] were fused to the surface of the core particles [1], with the result that a shell layer was formed. Here, an aqueous solution obtained by dissolving 150 g of sodium chloride in 600 g of ion exchange water was added, maturation processing was performed at 80° C., and the temperature was cooled to 30° C. when a desired circularity was reached.

(Washing/Drying Process)

The generated particles were subjected to solid-liquid separation with a basket type centrifugal separator "MARK III Model No. 60×40" (manufactured by Matsumoto Machine Co., Ltd.), and a wet cake of toner base particles was formed. This wet cake was washed with ion exchange water of 40° C. until the electric conductivity of a filtrate reaches 5 μS/cm in the basket type centrifugal separator, was then transferred to "Flash jet dryer" (manufactured by Seishin Enterprise Co., Ltd.) and was dried until the amount of water reaches 0.5% by mass, with the result that toner base particles [1] were obtained.

(External Additive Addition Process)

1% by mass of hydrophobic silica (number-average primary particle diameter=12 nm) and 0.3% by mass of hydrophobic titania (number-average primary particle diameter=20 nm) were added to the toner base particles [1], and resultant substance was mixed with a Henschel mixer, with the result that toner [1] was produced.

Examples 2 to 12, Comparative Examples 1 to 4: Production Examples 2 to 16 of the Toner Toners [2] to [16] were produced in the same manner as in the Production Example 1 of the toner except that, instead of the "ethylene(propylene)glycol chain-containing monomer (1-1)", ethylene(propylene)glycol chain-containing monomers shown in Tables 2 to 4 were used in accordance with Table 3, and that, as the crystalline ester compound, the crystalline ester compound shown in Table 1 was used in accordance with Table 3.

TABLE 2

| Ethylene (propylene) glycol chain-containing monomer No. | Structure —$R^1$ | —$R^2$ | m | n |
|---|---|---|---|---|
| (1-1) | —$CH_3$ | —$CH_3$ | 2 | 2 |
| (1-2) | —H | —$CH_3$ | 3 | 3 |
| (1-3) | —$CH_3$ | —$C_{12}H_{25}$ | 2 | 4 |
| (1-4) | —H | —$C_6H_5$ | 2 | 5 |
| (1-5) | —$CH_3$ | —$CH_3$ | 2 | 9 |
| (1-6) | —$CH_3$ | —$CH_3$ | 2 | 25 |
| (1-7) | —$CH_3$ | —$CH_3$ | 3 | 13 |
| (1-8) | —$CH_3$ | —$CH_3$ | 2 | 30 |

TABLE 3

| | Toner No. | Ethylene (propylene) glycol chain-containing monomer No. | Crystalline ester compound No. |
|---|---|---|---|
| Example 1 | 1 | (1-1) | [A1] |
| Example 2 | 2 | (1-2) | [A1] |
| Example 3 | 3 | (1-3) | [A1] |
| Example 4 | 4 | (1-1) | [A2] |
| Example 5 | 5 | (1-4) | [A3] |
| Example 6 | 6 | (1-5) | [A1] |
| Example 7 | 7 | (1-5) | [A4] |
| Example 8 | 8 | (1-5) | [A6] |
| Example 9 | 9 | (1-6) | [A5] |
| Example 10 | 10 | (1-7) | [A5] |
| Example 11 | 11 | (1-7) | [A7] |
| Example 12 | 12 | (1-7) | [A8] |
| Comparative example 1 | 13 | — | [A1] |
| Comparative example 2 | 14 | (1-8) | [A1] |
| Comparative example 3 | 15 | (1-1) | — |
| Comparative example 4 | 16 | (1-1) | [A9] |

[Manufacturing of the Developer]

A ferrite carrier being coated with a silicone resin and having a volume-average particle diameter of 35 μm was mixed with each of the toners [1] to [16] such that the concentration of the toners was 6%, and thus developers [1] to [16] were prepared.

Evaluation 1

Low-Temperature Fixing Property

By using a copying machine "bizhub PRO C6550" (manufactured by Konica Minolta Business Technologies, Inc.) which was modified so as to be able to change, from 120 to 200° C., the surface temperature (fixing temperature) of the heating roller of a fixing device, under an environment of constant temperature and constant humidity (temperature 20° C. and humidity 50% RH), a fixing experiment of fixing a solid image on high-quality paper of A4 size having the amount of attachment of toner of 10 mg/cm$^2$ was repeated while the set fixing temperature was changed such that it was increased by 5° C. from 120° C. to 200° C.

Among the fixing experiments in which an image stain caused by low-temperature offset was not visually observed, with assumption that the fixing temperature of the fixing experiment having the lowest fixing temperature was the lowest fixing temperature, an evaluation was performed. The results thereof are shown in Table 6. The result in which the lowest fixing temperature was 140° C. or less was determined to be acceptable.

Evaluation 2

Long-Term Stability of Charging

Under an environment of high temperature and high humidity (temperature 30° C., humidity 85% RH), a character image having a print rate of 10% was continuously printed on one hundred thousand sheets, then a test image including a white image and a halftone image was printed, fog on the print was observed and image roughness on the halftone image was observed and an evaluation was performed in accordance with the following evaluation criteria. The results thereof are shown in Table 4.

—Evaluation Criteria—

A: Neither decrease in image density nor fog was observed visually.

B: Although a decrease in image density and/or fog were/was slightly observed with a loupe of 20 times magnification, no problem was found in practical use.

C: Although a decrease in image density and/or fog were/was visually observed, no problem was found in practical use.

D: A decrease in image density and fog were visually observed, and a problem was found in practical use.

Evaluation 3

Heat-Resistant Storability 0.5 g of each of the toners [1] to [16] described above was put into a 10 mL glass bottle having an inside diameter of 21 mm, its lid was closed, the glass bottle was shaken 600 times at room temperature with a tap denser "KYT-2000" (manufactured by Seishin Enterprise Co., Ltd.) and thereafter the glass bottle was left with the lid being removed in an environment of a temperature of 55° C. and a humidity of 35% RH for 2 hours. Then, the toner was carefully placed on a sieve of 48 meshes (aperture 350 μm) such that a toner aggregate was not shredded, was set in "Powder tester" (manufactured by Hosokawa Micron Corporation) and was fixed with a pressure bar and a knob nut, the Power tester was adjusted to have a vibration strength with a feed width of 1 mm, the amount of toner left on the sieve was measured after application of vibration for 10 seconds, a rate of aggregation of the toner was calculated with the following formula (3) and thus an evaluation was performed. The results thereof are shown in Table 4.

Rate of aggregation of toner (% by mass)={Amount of toner left (g)/0.5 (g)}×100 Formula (2):

Meanwhile, a case where the rate of aggregation of the toner was less than 1.5% by mass was determined to be excellent, a case where it was equal to or more than 15% by mass but equal to or less than 20% by mass was determined to be satisfactory, and a case where it exceeds 20% by mass was determined to be unacceptable because practical use was impossible.

TABLE 4

| | Toner No. | Evaluation results: Low temperature fixing property | Long-term stability | Heat-resistant storability |
|---|---|---|---|---|
| Example 1 | 1 | 125° C. | A | 10% by mass |
| Example 2 | 2 | 125° C. | A | 10% by mass |
| Example 3 | 3 | 125° C. | A | 13% by mass |
| Example 4 | 4 | 135° C. | A | 19% by mass |
| Example 5 | 5 | 120° C. | A | 7% by mass |
| Example 6 | 6 | 120° C. | A | 7% by mass |
| Example 7 | 7 | 130° C. | A | 9% by mass |
| Example 8 | 8 | 135° C. | B | 15% by mass |
| Example 9 | 9 | 125° C. | A | 10% by mass |
| Example 10 | 10 | 125° C. | A | 7% by mass |
| Example 11 | 11 | 130° C. | B | 16% by mass |
| Example 12 | 12 | 135° C. | C | 15% by mass |
| Comparative example 1 | 13 | 130° C. | D | 28% by mass |
| Comparative example 2 | 14 | 130° C. | D | 31% by mass |
| Comparative example 3 | 15 | 155° C. | A | 15% by mass |
| Comparative example 4 | 16 | 145° C. | C | 23% by mass |

What is claimed is:

1. A toner for electrostatic-image development that is formed with toner particles containing a binder resin and a crystalline ester compound, wherein the crystalline ester compound has a linear-chain structure, and the binder resin contains a styrene-acrylic resin including a structural unit derived from an acrylic ester monomer represented by general formula (1) below:

General formula (1)

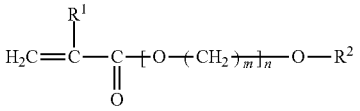

in the general formula (1), $R^1$ represents a hydrogen atom or a methyl group, $R^2$ represents a hydrogen atom, an alkyl group having 1 to 16 carbon atoms or an aryl group having 6 to 15 carbon atoms, m represents an integer of 2 or 3 and n represents an integer of 1 to 25.

2. The toner for electrostatic-image development according to claim 1, wherein a content of the structural unit derived from the acrylic ester monomer represented by the general formula (1) in the styrene-acrylic resin falls within a range of 2 to 20% by mass.

3. The toner for electrostatic-image development according to claim 1, wherein, in the general formula (1), $R^1$ is a methyl group.

4. The toner for electrostatic-image development according to claim 1, wherein, in the general formula (1), $R^2$ is a methyl group.

5. The toner for electrostatic-image development according to claim 1, wherein, in the general formula (1), m is 2.

6. The toner for electrostatic-image development according to claim 1, wherein, in the general formula (1), n is an integer of 2 to 20.

7. The toner for electrostatic-image development according to claim 1, wherein, in the general formula (1), n is an integer of 2 to 15.

8. The toner for electrostatic-image development according to claim 1, wherein, in the general formula (1), n is an integer of 5 to 13.

9. The toner for electrostatic-image development according to claim 1, wherein a content of the crystalline ester compound in the toner particles is 1 to 30% by mass.

10. The toner for electrostatic-image development according to claim 1, wherein the crystalline ester compound is a compound having two or more ester bonds.

11. The toner for electrostatic-image development according to claim 10, wherein the crystalline ester compound is a crystalline polyester resin having four or more ester bonds.

12. The toner for electrostatic-image development according to claim 1, wherein the crystalline ester compound has a melting point that is equal to or more than 60° C. and, less than 90° C.

13. The toner for electrostatic-image development according to claim 12, wherein, when a solubility parameter value (SP value: $(cal/cm^3)^{1/2}$) of the crystalline ester compound is SP(E), and a solubility parameter value of the binder resin is SP(resin), $0<SP(resin)-SP(E)\leq 2.0$ is satisfied.

14. The toner for electrostatic-image development according to claim 1, wherein the toner particles contain a wax having a composition different from a composition of the crystalline ester compound.

15. The toner for electrostatic-image development according to claim 14, wherein, when a solubility parameter value (SP value $(cal/cm^3)^{1/2}$) of the crystalline ester compound is SP(E) and a solubility parameter value of the wax is SP(W), $SP(W)<SP(E)$ is satisfied.

16. The toner for electrostatic-image development according to claim 14, wherein, when a melting point of the crystalline ester compound is Tm(E) and a melting point of the wax is Tm(W), $Tm(W)<TM(E)$ is satisfied.

* * * * *